US006016648A

United States Patent [19]

Bettcher et al.

[11] Patent Number: 6,016,648

[45] Date of Patent: Jan. 25, 2000

[54] YARN AND SAFETY APPAREL

[75] Inventors: William H. Bettcher, Vermilion; Keith A. Furgalus, Rocky River; Joseph Hummel, Amherst, all of Ohio

[73] Assignee: Whizard Protective Wear Corp., Niles, Ill.

[21] Appl. No.: 08/206,022

[22] Filed: Feb. 25, 1994

Related U.S. Application Data

[63] Continuation of application No. 08/058,683, May 3, 1993, abandoned, which is a continuation of application No. 07/651,139, Feb. 6, 1991, abandoned.

[51] Int. Cl.[7] ..... D02G 3/06

[52] U.S. Cl. ..... 57/230; 57/212; 57/222

[58] Field of Search ..... 57/210, 212, 222, 57/229, 230

[56] References Cited

U.S. PATENT DOCUMENTS

| | | | |
|---|---|---|---|
| 3,607,822 | 9/1971 | Nishino | 524/847 |
| 3,700,515 | 10/1972 | Terry | 156/72 |
| 3,821,067 | 6/1974 | Taylor et al. | 428/96 |
| 3,895,149 | 7/1975 | Sheffler et al. | 428/94 |
| 3,923,926 | 12/1975 | Harada et al. | 528/66 |
| 4,267,044 | 5/1981 | Kroplinski et al. | 210/321.77 |
| 4,384,449 | 5/1983 | Byrnes, Sr. et al. | 57/210 |
| 4,470,251 | 9/1984 | Bettcher | 57/210 |
| 4,640,950 | 2/1987 | Nishino et al. | 524/265 |
| 4,777,789 | 10/1988 | Kolmes et al. | 57/210 |
| 4,838,017 | 6/1989 | Kolmes et al. | 57/210 |
| 4,912,781 | 4/1990 | Robins et al. | 2/167 |
| 4,936,085 | 6/1990 | Kolmes et al. | 57/229 |

FOREIGN PATENT DOCUMENTS 2018323 1/1983 United Kingdom .

OTHER PUBLICATIONS

The Whizard Cut–Resistant Liner II Glove, Jul. 1989, Form 789.

The Whizard Knife Handler Glove, Sep. 1990, Form 990–4.

The Whizard Gripguard Glove, May 1985, Bulletin GG 585.

*Primary Examiner*—William Stryjewski

[57] ABSTRACT

Cut-resistant yarn suitable for machine knitting and machine-knitted protective articles of apparel, more specifically flexible gloves, at least in part made from such a yarn and also such gloves having a slip-resistant coating, preferably polyurethane, applied in a predetermined pattern to the outside surface of the gloves. The yarn utilizes a core of synthetic fibers held in a bundle by two initial wraps of low denier synthetic material having widely spaced turns or by a plastic coating on, or by a plastic matrix for, the fibers. One or more strands of metal wire or glass fiber are disposed about the core. The initial wraps or plastic that bundle the core create a uniform, cylindrical shape to the multi-filament fiber core that is believed to increase cut-resistance and that promotes uniformity in yarn diameter as subsequent wraps are applied, and prevent sharp bends in the wire or glass fibers disposed about the core. Additional wraps cover the wire or glass fiber.

43 Claims, 2 Drawing Sheets

YARN AND SAFETY APPAREL

This is a continuation of application Ser. No. 08/058,683 filed May 3, 1993 now abandoned, which is a continuatiin of application Ser. No. 07/651,139 filed on Feb. 6, 1991 now abandoned.

TECHNICAL FIELD

The invention relates to cut-resistant yarn suitable for machine knitting and to safety apparel made with the yarn.

BACKGROUND ART

Cut-resistant yarn utilizing stainless steel wire in a core, typically along with high strength synthetic fiber, and wound with synthetic fiber, including high strength synthetic fiber, and apparel made from such yarn, are known from, e.g., the Byrnes et al. U.S. Pat. No. 4,384,449 and the Bettcher U.S. Pat. No. 4,470,251. While the yarns disclosed in those patents use aramid fiber to enhance cut-resistance, it is also known to use high strength stretched polyethylene fiber for that purpose. Cut-resistant yarns have also been proposed in which a wire strand is not in the core, but rather wrapped about a core. See, e.g., Kolmes et al. U.S. Pat. Nos. 4,777,789 and 4,838,017. There is a need for an improved knittable cut-resistant yarn construction in which wire is provided about the core rather than forming the core.

DISCLOSURE OF INVENTION

The present invention provides an improved cut-resistant yarn suitable for machine knitting, and protective apparel made from the yarn, such as gloves, protective sleeves, and the like. The yarn utilizes metal wire or wires wrapped about a core of fiber. Because of the wrapping, a relatively greater amount of wire is incorporated into the yarn than when the wire is a straight core strand. This arrangement often results in more than a single contact between the wire and a sharp object applied against the yarn. In addition, the wire, being in a helix, is not subjected to the tension or sharp bending that a central core wire is during the knitting process.

The yarn of the present invention is an improvement over known yarns having wire wraps about a core, especially by the provision of two initial wraps of low denier synthetic material having widely spaced turns about a multifilament core strand and beneath the wire wrap. The two initial wraps bundle the core filaments and create a uniform, cylindrical shape to the multi-filament fiber core that is believed to increase cut-resistance and that promotes uniformity in yarn diameter as subsequent wraps are applied, and avoids sharp bends in the wrapping wire that can occur with a core made from a multifilament strand that is relatively flat or that is irregular in cross-sectional shape. This uniformity is particularly important in a yarn having a large number of wraps, and in preferred embodiments of the yarn of this invention, five wraps are utilized. Also, in preferred embodiments, wire is wound only in a single direction, avoiding crossing of wire strands, thereby eliminating wear points that tend to fracture and eliminating irregularities in the yarn thickness that otherwise might occur at cross-over points.

The invention also contemplates glass fibers in place of or in addition to the wire or wires wrapped about the bundled core filaments. In its broad aspects, the invention provides a cut-resistant yarn suitable for machine knitting, comprising:

(a) a core of synthetic fibers, (b) a first wrap of synthetic fiber the turns being widely spaced, (c) a wrap having a maximum diameter of 0.010 inch of material selected from the group consisting of metal wire and glass fiber, two to twelve turns per inch, disposed about the core and first wrap, and (d) two wraps of synthetic fiber each wrapped in an opposite direction about the core, with successive turns directly adjacent each other.

In its broad aspects, the invention also provides a cut-resistant yarn suitable for machine knitting, comprising:

(a) a 500 to 1500 denier core comprised of synthetic fibers (b) means retaining the core fibers in a bundle;

(c) a wrap having a maximum diameter of 0.010 inch of material selected from the group consisting of metal wire and glass fiber, two to twelve turns per inch, disposed about the core and said means;

(d) a wrap of 300 to 2000 denier synthetic fiber disposed about the wrap of wire or wires, with turns directly adjacent each other; and (e) another wrap of 300 to 2000 denier synthetic fiber disposed about the first-mentioned wrap of synthetic fiber, with turns directly adjacent each other.

The invention further provides a cut-resistant machine-knitted protective article of apparel, and more specifically a flexible glove, at least in part made from such a yarn and also such a glove having a slip-resistant coating, preferably polyurethane, applied in a predetermined pattern to the outside surface of the glove.

In one preferred construction, the yarn comprises a core having a strand of multifilament high strength stretched polyethylene fiber of 500 to 1200 denier, and the following wraps wound with helical turns about the core in the order set forth:

(a) a first wrap of 50 to 200 denier texturized nylon, four to ten turns per inch;

(b) a second wrap of 50 to 200 denier texturized nylon wound in the opposite direction from the first wrap, four to ten turns per inch;

(c) a third wrap having a maximum diameter of 0.010 inch of annealed stainless steel wire or wires, four to twelve wraps per inch;

(d) a fourth wrap of 200 to 800 denier polyester fiber, the turns being directly adjacent each other; and (e) a fifth wrap of two 200 to 800 denier strands of polyester fiber wrapped in the opposite direction from the fourth wrap, the turns being directly adjacent each other.

In another preferred construction, the yarn comprises a core having a strand of multifilament high strength stretched polyethylene fiber of 500 to 1200 denier, and the following wraps wound with helical turns about the core in the order set forth:

(a) a first wrap of 50 to 200 denier nylon, four to ten turns per inch;

(b) a second wrap of 50 to 200 denier nylon wound in the opposite direction from the first wrap, four to ten turns per inch;

(c) a third wrap having a maximum diameter of 0.010 inch of stainless steel wire or wires, four to twelve wraps per inch;

(d) a fourth wrap of 300 to 1200 denier high strength stretched polyethylene fiber, the turns being directly adjacent each other; and (e) a fifth wrap of 600 to 1500 denier polyester fiber wrapped in the opposite direction from the fourth wrap, the turns being directly adjacent each other.

The above and other features and advantages will become more apparent from the detailed description that follows.

BEST MODE FOR CARRYING OUT THE INVENTION

Figure 1:
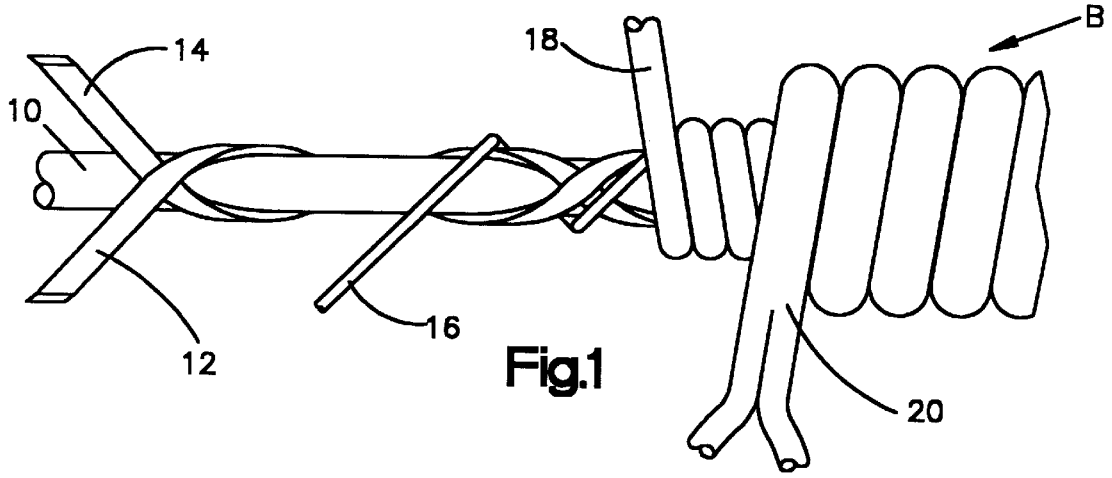
FIG. 1 is a fragmentary, diagrammatic view of a first yarn embodying the invention.
Figure 2:
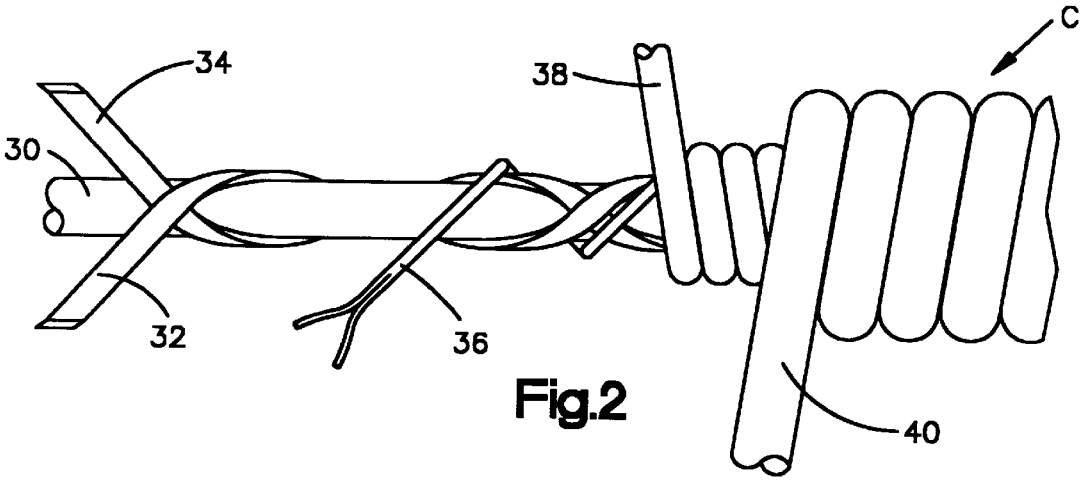
FIG. 2 is a fragmentary, diagrammatic view of a second yarn embodying the invention.
Figure 3:
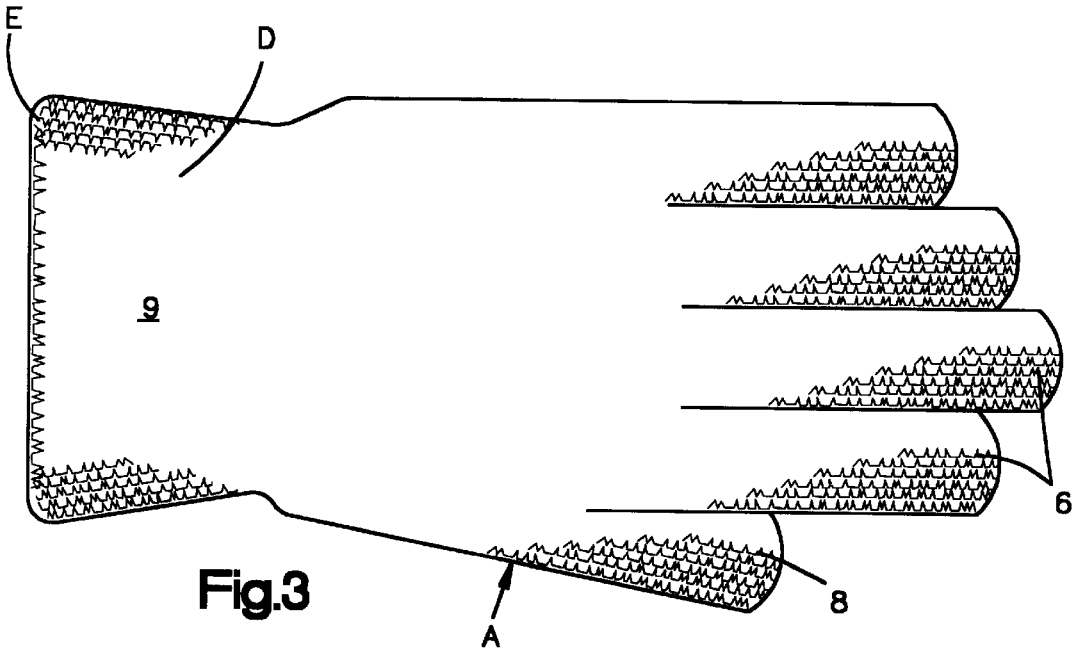
FIG. 3 is a diagrammatic view of an article of apparel, i.e., a knitted glove, made of yarn constructed in accordance with the invention, such as the yarn of FIG. 1 or 2.

The depicted glove A is exemplary of safety articles of apparel embodying the present invention (other such articles including sleeves, neck protectors, aprons, leggings and the like) and is a safety or protective glove suitable to be worn by operatives in the food processing and like industries where sharp instruments or articles, such as knives or material having sharp edges, for example, sheet metal, glass and the like, are handled. The glove is made of composite or multistrand yarn B or C constructed in accordance with the present invention. The glove A has the usual finger and thumb stalls 6, 8, respectively, and a wrist part 9 incorporating an elastic thread or yarn D and finished with an overwrap E. The glove is made using conventional glove knitting methods and machinery.

The yarn B comprises a core part 10 and multiple wraps 12, 14, 16, 18 and 20 applied one after the other and each wound helically in an opposite direction from the preceding one, which helps balance forces incident to the wrappings so the yarn has no unusual twist or tendency to coil and assists in holding the wrappings in place on the core.

The core part 10 is a multifilament bundle of 650 denier high strength stretched polyethylene synthetic fiber, preferably "Spectra 900" marketed by Allied Corporation, Morris Township, Morris County, N.J., U.S.A. The fiber is described in detail in U.S. Pat. No. 4,413,110 to Kavesh et al., the specification of which is hereby incorporated herein by reference. The core material provides high cut-resistance, knitability, flexibility and life to the yarn. Multifilament fiber of Spectra, as supplied by the manufacturer, is relatively flat in form.

The first two wraps 12, 14 are identical but wound in opposite directions about the core 10, and are each 100 denier texturized multifilament nylon and wrapped at a rate or pitch of six turns per inch along the core. These two wraps bundle the filaments of the core and also increase the diameter about which a wire wrap 16 is wound so as to increase the amount of wire used. With the core filaments bundled, they present a unified mass rather than a spread out and thinner layer of filaments to a sharp object, to which the core may be exposed when the yarn is in use, and it is believed to be more difficult to cut through such an arrangement of bundled multiple filaments. The bundled core filaments also present a substantially cylindrical and desirably uniform shape about which to wrap the wire 16 and subsequent wraps, thereby avoiding sharp bends in the wire and keeping the spacing of successive turns of the wire relatively uniform along the length of the core. The texturized nylon has enhanced softness that minimizes irregularities when overwound with successive wraps and thereby promotes a finished yarn of more uniform diameter.

The third wrap 16 is a single fully annealed stainless steel wire 0.003 inch in diameter that is wound about the core and first two wraps at a rate of 8 turns per inch, uniformly spaced. The length of this wire is approximately 35 percent greater than the length of the core strand, and hence greater by the same amount than the length of a straight core wire would be if used, thereby providing an increased amount of steel in the yarn over a straight core wire of the same diameter. By virtue of the helical shape of the wire, a knife blade or other sharp object approaching the yarn at an angle other than that of the wire helix will tend to have to cut through the wire of each composite yarn strand at more than one location, thereby meeting increased resistance over a core wire, which only interrupts the cutting path once.

The fourth wrap 18 is a strand of 440 denier multifilament polyester fiber wrapped in the opposite direction from that of the wire, with each turn directly adjacent the next to provide a substantially complete covering to the underlying turns and core.

The fifth wrap 20 is two strands or so-called ends of 440 denier multifilament polyester fiber wrapped together in the opposite direction from the fourth wrap, with each turn directly adjacent the next to provide a substantially complete covering to the fourth wrap. Where it is desired to impart a color to the yarn, the fourth and fifth wraps, being of polyester, may be dyed. The fourth and fifth wraps, while not of highly cut-resistant material, add body to the yarn and provide good comfort and feel to a garment made from the yarn because the material is soft, flexible, and non-abrasive, and is not slippery, as is Spectra.

The yarn C comprises a core part 30 and multiple wraps 32, 34, 36, 38 and 40 applied one after the other and each wound helically in an opposite direction from the preceding one, which helps balance forces incident to the wrappings so the yarn has no unusual twist or tendency to coil and assists in holding the wrappings in place on the core.

The core part 30 is a multifilament strand of 650 denier high strength stretched polyethylene synthetic fiber, preferably "Spectra 900" identical to the core part 10.

The first two wraps 32, 34 are identical but wound in opposite directions about the core 30, and are each 70 denier multifilament nylon fiber and wrapped at a rate of six turns per inch along the core. These two wraps bundle the filaments of the core so they present a unified mass rather than a spread out and thinner layer of fibers to a sharp object, in the same manner and to the same advantage as the wraps 12, 14.

The third wrap 36 is two (or alternatively preferred embodiments may use one or three) fully annealed stainless steel wires each 0.0016 inch in diameter that are together wound as a strand in one direction about the core 30 and the first two wraps 32, 34 at a rate of 8 turns per inch, uniformly spaced, for the same purpose and to the same effect as the wire 16 in the yarn B, the length of the wire strand being similarly increased over a straight strand. While the volume of steel is diminished over that provided in yarn B, the surface area for contacting a sharp object is comparable and the flexibility is greater. Also, the profile is lower, resulting in a smoother base for subsequent wraps, and if wires are broken in knitting or in use, the broken ends do not cause the discomfort that ends of larger diameter wire do because they are not as stiff and tend not to prick the skin of the wearer.

The fourth wrap 38 is a strand of 650 denier Spectra 900 fiber identical to the core strand, wrapped in a direction opposite to that of the wrap 36, with each turn directly adjacent the next to provide a substantially complete covering to the underlying turns and core. Because of the high cut-resistance of Spectra, this wrap adds substantial cut-resistance to the yarn C.

The fifth wrap 40 is a strand of 1300 denier multifilament polyester fiber wrapped in the opposite direction from the fourth wrap, with each turn directly adjacent the next to provide a substantially complete covering to the fourth wrap. The fifth wrap, while not of highly cut-resistant material, adds body to the yarn and provide good comfort and feel to a garment made from the yarn because the material is soft, flexible, and non-abrasive, and is not slippery, as is Spectra.

The finished diameter of the yarns is between about 0.019 and 0.035 inch, and preferably not greater than 0.025 inch, to facilitate machine knitting on conventional knitting machines.

Modifications to the preferred embodiments can be made without departing from the invention. For example, synthetic materials other than the high strength stretched polyethylene can be used. If lower cut-resistance is acceptable, non-high strength synthetic fibers may be substituted while still gaining the advantages of the physical arrangement provided by the invention, particularly the advantages of the bundling of the core and the use of a wire wrap. Also, normal strength synthetic fibers other than nylon and polyester can be used, such as polyethylene, polypropylene, or teflon. Glass fibers of a denier from 150 to 2000, typically E glass or S glass, can also be used as a core or wrap. High strength or so-called high performance fibers other than high strength stretched polyethylene (which is sometimes referred to as extended-chain polyethylene) that can be used include high strength aramid fibers, such as high strength Kevlar sold by E. I. duPont de Nemours, and high strength liquid crystal polymer fibers, such as Vectran HS, sold by Hoechst Celanese Corporation, Charlotte, N.C. A high strength synthetic fiber material is defined for present purposes as a fiber material having a tenacity of greater than 10 grams per denier. Preferably the high strength fiber material will have a tenacity greater than 20 grams per denier.

In yarns B and C, the core may have a denier of between 500 and 2000, but preferably between 500 and 1500; the first and second wraps may have a denier of between 50 and 400 and be wrapped at least two turns per inch, preferably four to ten turns per inch; the third wrap, when of wire, may be one or more annealed stainless steel or other metal wires and, whether of wire or glass fiber, may be up to 0.010 inch in total diameter and wrapped at least two wraps per inch, preferably four to twelve wraps per inch; the fourth wrap may have a denier of 300 to 1200, and the fifth wrap may have a denier of 600 to 1500. Modifications may include other wraps located among those indicated.

The expression of total diameter of the wrap of metal wires or glass fibers is intended to specify the size when the fibers are arranged in a bundle that is substantially circular in cross sectional shape, regardless of the actual cross sectional shape the wires or fibers take when incorporated into the yarn, which shape may be non-circular.

Notwithstanding the variations available, the preferred embodiments are believed to offer the most advantageous constructions, considering both cost and the various performance characteristics of cut-resistance, yarn uniformity, knitability, comfort, wear, flexibility, cleanability, low fluid absorption, and appearance.

The preferred stainless steel wire is 304 stainless steel (although other 300 series stainless steels are also acceptable and advantageous) having a tensile strength of about 110,000 to 130,000 pounds per square inch. The preferred high strength fiber is Spectra, which has a tenacity of 15 to 35 grams per denier and an elongation-to-break of not more than 5%.

Figure 4:
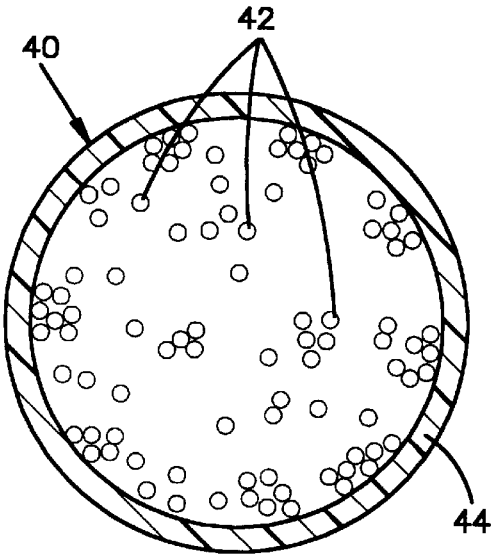
FIG. 4 is a diagrammatic enlarged cross sectional view of a multifilament core in which the filaments are bundled by a coating.
Figure 5:
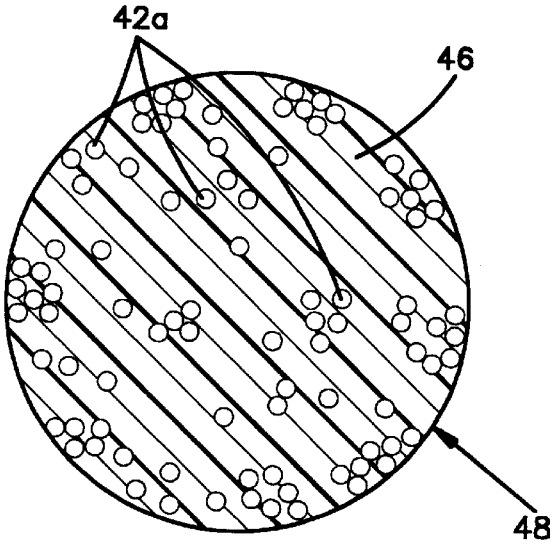
FIG. 5 is a diagrammatic enlarged cross sectional view of a multifilament core in which the filaments are bundled by a matrix.

As an alternative to bundling the core fibers 10 or 30 with wraps 12, 14 or 32, 34, a core 40 shown in FIG. 4 can be used comprised of synthetic multifilaments 42, preferably of high strength fiber, such as a Spectra, and held in a bundle substantially circular in cross section by a plastic coating 44, e.g., Surlyn, although other coatings such as thermoplastics, polyurethane and the like may be used. Preferably, the coating is no more than 0.005 inch thick. As a further alternative, multifilament fibers 42*a* identical to fibers 42 may be held in a similarly shaped bundle by a plastic matrix 46 of a material such as any of those used for the coating 44, to form a core 48 as shown in FIG. 5, to be used in place of the cores 10 or 30 and wraps 12, 14 or 32, 34. Such a core is predominantly fibers.

Figure 6:
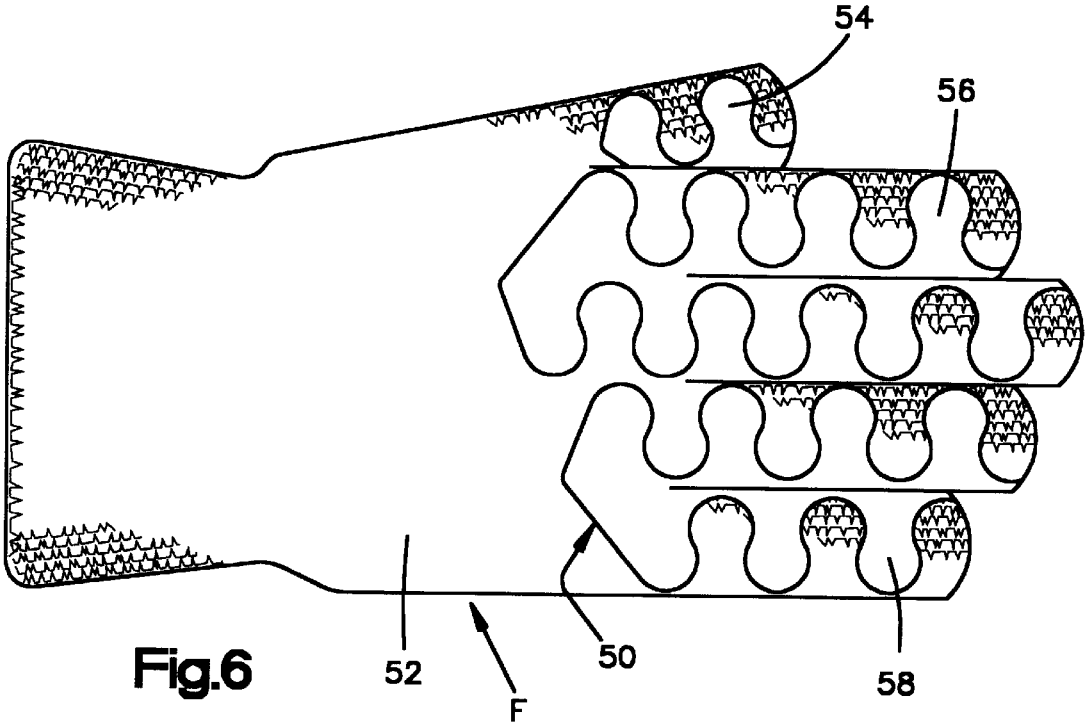
FIG. 6 is a diagrammatic view of a knitted glove made of yarn constructed in accordance with the invention and having a polyurethane coating on a surface in a pattern.

A glove F is shown in FIG. 6 knit from the yarn 10 and has a polyurethane coating 50 on an outer surface 52. The coating is a mixture of thixotropic and non-thixotropic resins and is applied in a desired pattern directly to the glove surface by an applicator. The resin mixture partially permeates the yarn for adhesion upon curing, but does not strike through to the inside of the glove. The cured coating is cut-resistant, soft, flexible and slip-resistant (i.e., it has a high coefficient of friction against relatively dry surfaces), and is securely adhered to the glove. The preferred pattern shown is formed by three separate sinuous strips 54, 56, 58 of polyurethane approximately 1/32 inch high and 1/16 inch wide that do not intersect at any place. The pattern provides predominantly lateral lines across the finger stalls with connecting loops only to the extreme sides of the finger stalls, so in use the wearer need not buckle coating strips extending along central areas of the finger stalls when the fingers are bent. A more detailed description of the coating and process for applying it to knitted cut-resistant gloves, as well as a description of other embodiments of gloves to which it is applied, can be found in copending U.S. patent application Ser. No. 07/604,589 filed Oct. 26, 1990, owned by the assignee of this application, the disclosure of which is hereby incorporated herein by reference.

While preferred embodiments of the invention have been described in detail, it will be understood that various modifications and alterations may be made therein without departing from the spirit and scope of the invention set forth in the appended claims.

We claim:

1. A cut-resistant yarn suitable for machine knitting, having a core comprised of high strength stretched polyethylene fibers and the following wraps wound with helical turns about the core in the order set forth:

(a) a first wrap of nylon, six turns per inch;

(b) a second wrap of nylon wound in the opposite direction from the first wrap, six turns per inch;

(c) a third wrap of a single annealed stainless steel wire 0.003 inch in diameter or one to three annealed stainless steel wires 0.0016 inch in diameter, eight wraps per inch;

(d) a fourth wrap of polyester fiber, the turns being directly adjacent each other; and (e) a fifth wrap of two polyester fiber wrapped in the opposite direction from the fourth wrap, the turns being directly adjacent each other.

2. A cut-resistant yarn suitable for machine knitting, having a 500–1500 denier core comprised of high strength stretched polyethylene fiber and the following wraps wound with helical turns about the core in the order set forth:

(a) a first wrap of 50 to 400 denier nylon, at least two turns per inch;

(b) a second wrap of 50 to 400 denier nylon wound in the opposite direction from the first wrap, at least two turns per inch;

(c) a third wrap having a maximum diameter of 0.010 inch of material selected from the group consisting of metal wire and glass fiber, two to twelve wraps per inch;

(d) a fourth wrap of 200 to 800 denier polyester fiber, the turns being directly adjacent each other; and (e) a fifth wrap of two 200 to 800 denier strands of polyester fiber wrapped in the opposite direction from the fourth wrap, the turns being directly adjacent each other.

3. A cut-resistant yarn suitable for machine knitting, having a core comprised of synthetic fiber and the following wraps wound with helical turns about the core:

a) a first wrap of at least 50 denier synthetic fiber wound, at least two turns per inch;

b) a second wrap of at least 50 denier synthetic fiber wound in the opposite direction from the first wrap, at least two turns per inch;

c) a third wrap having a maximum diameter of 0.010 inch of material selected from the group consisting of metal wire and glass fiber, two to twelve wraps per inch;

d) a fourth wrap of 200 to 2000 denier synthetic fiber, the turns being directly adjacent each other; and e) a fifth wrap of 200 to 2000 denier synthetic fiber wrapped in the opposite direction from the fourth wrap, the turns being directly adjacent each other.

4. A cut-resistant yarn as set forth in claim 3 wherein the core is of high strength synthetic fiber.

5. A cut-resistant yarn as set forth in claim 4 wherein the fourth wrap is a high strength synthetic fiber.

6. A cut-resistant yarn as set forth in claim 5 wherein the high strength synthetic fiber is selected from the group consisting of high strength aramid, high strength stretched polyethylene and high strength liquid crystal polymer.

7. A cut-resistant yarn as set forth in claim 4 wherein the high strength synthetic fiber is selected from the group consisting of high strength aramid, high strength stretched polyethylene and high strength liquid crystal polymer.

8. A cut-resistant yarn as set forth in claim 3 wherein the fourth wrap is a high strength synthetic fiber.

9. A cut-resistant yarn as set forth in claim 8 wherein the high strength synthetic fiber is selected from the group consisting of high strength aramid, high strength stretched polyethylene and high strength liquid crystal polymer.

10. A cut-resistant yarn as set forth in claim 8 wherein the core synthetic fiber is glass fiber.

11. A cut-resistant yarn as set forth in claim 3 wherein the fifth wrap is comprised of two 150 to 1000 denier strands of synthetic fiber wrapped in the opposite direction from the fourth wrap, the turns being directly adjacent each other.

12. A cut-resistant yarn as set forth in claim 3 wherein the fourth wrap is a polyester fiber of 200 to 800 denier.

13. A cut-resistant yarn as set forth in claim 3 wherein the fifth wrap is two 200 to 800 denier strands of polyester of fiber.

14. A cut-resistant yarn as set forth in claim 3 wherein the first and second wraps are nylon.

15. A cut-resistant yarn as set forth in claim 3 wherein the core synthetic fiber is glass fiber.

16. A cut-resistant yarn as set forth in claim 3 wherein the third wrap is metal wire.

17. A cut-resistant yarn suitable for machine knitting, having a 500 to 1500 denier core comprised of synthetic fiber and the following wraps wound with helical turns about the core in the order set forth:

(a) a first wrap of 70 denier nylon, six turns per inch;

(b) a second wrap of 70 denier nylon wound in the opposite direction from the first wrap, six turns per inch;

(c) a third wrap of one to three annealed stainless steel wires each 0.0016 inch in diameter, eight turns per inch;

(d) a fourth wrap of 650 denier high strength stretched polyethylene fiber having directly adjacent turns; and (e) a fifth wrap of 1300 denier polyester fiber wrapped in the opposite direction from the fourth wrap and having directly adjacent turns.

18. A cut-resistant yarn suitable for machine knitting, having a core comprised of high strength stretched polyethylene fiber up to 1500 denier and the following wraps wound with helical turns about the core in the order set forth:

(a) a first wrap of at least 50 denier synthetic fiber, at least two turns per inch;

(b) a second wrap of at least 50 denier synthetic fiber wound in the opposite direction from the first wrap, at least two turns per inch;

(c) a third wrap having a maximum diameter of 0.010 inch of material selected from the group consisting of metal wire and glass fiber, two to twelve wraps per inch;

(d) a fourth wrap of 300 to 2000 denier high strength stretched polyethylene fiber, the turns being directly adjacent each other; and (e) a fifth wrap of 300 to 2000 denier synthetic fiber wrapped in the opposite direction from the fourth wrap, the turns being directly adjacent each other.

19. A cut-resistant-yarn as set forth in any one of claims 1, 2, 17 or 18 having a diameter of from 0.019 to 0.035 inch.

20. A cut-resistant yarn suitable for machine knitting, having a 150–2000 denier core comprised of synthetic fiber and the following wraps wound about the core:

(a) one or more wraps W1 of at least 50 denier synthetic fiber, at least two turns per inch, said turns being widely spaced each from the next, the first of said wraps W1 wound directly about the core;

(b) a wrap W2 having a maximum diameter of 0.010 inch of material selected from the group consisting of metal wire and glass fiber, two to twelve turns per inch, disposed about the wrap or wraps W1;

(c) a wrap W3 of 300 to 2000 denier synthetic fiber having a tenacity of greater than 10 grams per denier selected from the group consisting of high strength aramid, high strength stretched polyethylene and high strength liquid crystal polymer disposed about the wrap W2, the turns being directly adjacent each other; and (d) a wrap W4 of 300 to 2000 denier synthetic fiber disposed about the wrap W3, the turns being directly adjacent each other.

21. A cut-resistant yarn as set forth in claim 20 wherein the core is of high strength synthetic fiber.

22. A cut-resistant yarn as set forth in claim 21 wherein the high strength synthetic core fiber is selected from the group consisting of high strength aramid, high strength stretched polyethylene and high strength liquid crystal polymer.

23. A cut-resistant yarn as set forth in claim 20 wherein the core synthetic fiber is glass fiber.

24. A cut-resistant yarn as set forth in claim 20 wherein the wrap W2 is metal wire.

25. A cut-resistant yarn suitable for machine knitting having a core of at least 150 denier comprised of synthetic fiber and the following wraps wound with helical turns about the core:

a) a first wrap of 50 to 400 denier synthetic fiber, at least two turns per inch;

b) a second wrap of 50 to 400 denier synthetic fiber wound in the opposite direction from the first wrap, at least two turns per inch;

c) a third wrap having a maximum diameter of 0.010 inch of material selected from the group consisting of metal wire and glass fiber, two to twelve turns per inch;

d) a fourth wrap of 200 to 2000 denier synthetic fiber, the turns being directly adjacent each other; and e) a fifth wrap of 200 to 2000 denier synthetic fiber wrapped in the opposite direction from the fourth wrap, the turns being directly adjacent each other.

26. A cut-resistant yarn as set forth in claim 25 wherein the core is of a high-strength synthetic fiber.

27. A cut-resistant yarn as set forth in claim 26 wherein the fourth wrap is a high-strength synthetic fiber.

28. A cut-resistant yarn as set forth in claim 27 wherein the high-strength synthetic fiber of the core or fourth wrap or both is selected from the group consisting of high-strength aramid, high-strength stretched polyethylene and high-strength liquid crystal polymer.

29. A cut-resistant yarn as set forth in claim 26 wherein the high-strength synthetic fiber is selected from the group consisting of high-strength aramid, high-strength stretched polyethylene and high-strength liquid crystal polymer.

30. A cut-resistant yarn as set forth in claim 25 wherein the core is a glass fiber.

31. A cut-resistant yarn as set forth in claim 25 wherein the fourth wrap is a high-strength synthetic fiber having a denier of 300 to 1200.

32. A cut-resistant yarn as set forth in claim 31 wherein the fourth wrap is the high-strength fiber selected from the group consisting of high-strength aramid, high-strength stretched polyethylene and high-strength liquid crystal polymer.

33. A cut-resistant yarn as set forth in claim 25 wherein the fourth wrap is a polyester fiber having a denier of 200 to 800.

34. A cut-resistant yarn as set forth in claim 25 wherein the fifth wrap is comprised of two 150 to 1000 denier strands of synthetic fiber wrapped in the opposite direction from the fourth wrap, the turns being directly adjacent each other.

35. A cut-resistant yarn as set forth in claim 25 wherein the first and second wraps are a texturized nylon.

36. A cut-resistant yarn as set forth in any one of claims 25–35 wherein the fifth wrap is polyester fiber.

37. A cut-resistant yarn suitable for machine knitting, having a core of at least 150 denier comprised of synthetic fiber and the following wraps wound about the core:

(a) one or more wraps W2 of synthetic fiber, at least two turns per inch, said turns being widely spaced each from the next, the first of said wraps W1 wound directly about the core;

(b) a wrap W2 of flexible metal wire having a maximum diameter of 0.010 inch, two to twelve turns per inch, disposed about the wrap or wraps W1;

(c) a wrap W3 of 300 to 2000 denier synthetic fiber disposed about the wrap W2, the turns being directly adjacent each other; and (d) a wrap W4 of 300 to 2000 denier synthetic fiber disposed about the wrap W3, the turns being directly adjacent each other.

38. A cut-resistant yarn as set forth in claim 37 wherein the wrap W3 is a high strength synthetic fiber.

39. A cut-resistant yarn as set forth in claim 38, wherein the core is of glass fibers or high strength synthetic fiber.

40. A cut-resistant yarn as set forth in claim 37 wherein the wire of wrap W2 is comprised of plural strands grouped together and wrapped in a single direction.

41. A cut-resistant yarn suitable for machine knitting, having a 500 to 1500 denier core comprised of non-high strength synthetic fibers and the following wraps wound with helical turns about the core in the order set forth:

(a) a first wrap of at least 50 denier synthetic fiber, four to ten turns per inch;

(b) a second wrap of at least 50 denier synthetic fiber wound in the opposite direction from the first wrap, four to ten turns per inch;

(c) a third wrap having a maximum diameter of 0.010 inch of one to three annealed stainless steel wires, four to twelve turns per inch;

(d) a fourth wrap of 300 to 1200 denier high strength stretched polyethylene fiber, the turns being directly adjacent each other; and (e) a fifth wrap of 600 to 1500 denier polyester fiber wrapped in the opposite direction from the fourth wrap, the turns being directly adjacent each other.

42. A cut-resistant yarn as set forth in any one of claims 1–11, 15–18, 20–35 and 37–41 in the form of a knitted protective article of apparel.

43. A cut-resistant yarn as set forth in claim 42 wherein the article of apparel is a glove.

* * * * *

UNITED STATES PATENT AND TRADEMARK OFFICE
CERTIFICATE OF CORRECTION

PATENT NO.: 6,016,648

DATED: January 25, 2000

INVENTOR(S): William H. Bettcher, Keith a.Furgalus and Joseph Hummel

It is certified that error appears in the above-identified patent and that said Letters Patent is hereby corrected as shown below:

Claim 54, column 10, line 10, "wraps W2" should read -- wraps W1 --.

Signed and Sealed this

Third Day of October, 2000

*Attest:*

Q. TODD DICKINSON

*Attesting Officer*

*Director of Patents and Trademarks*